US005132203A

United States Patent [19]

Bell et al.

[11] Patent Number: 5,132,203

[45] Date of Patent: Jul. 21, 1992

[54] TABULAR GRAIN EMULSIONS CONTAINING LAMINAR HALIDE STRATA

[75] Inventors: Eric L. Bell, Webster; Kenneth J. Reed, Rochester; Myra T. Olm, Webster, all of N.Y.

[73] Assignee: Eastman Kodak Company, Rochester, N.Y.

[21] Appl. No.: 667,144

[22] Filed: Mar. 11, 1991

[51] Int. Cl.[5] ..... G03C 1/035; G03C 1/09

[52] U.S. Cl. ..... 430/567; 430/569; 430/604; 430/605

[58] Field of Search ..... 430/567, 569, 604, 605

[56] References Cited

U.S. PATENT DOCUMENTS

| | | | |
|---|---|---|---|
| 3,790,390 | 2/1974 | Shiba et al. | 430/567 |
| 3,890,154 | 6/1975 | Ohkubo et al. | 430/434 |
| 4,147,542 | 4/1979 | Habu et al. | 430/346 |
| 4,434,226 | 2/1984 | Wilgus et al. | 430/567 |
| 4,439,520 | 3/1984 | Kofron et al. | 430/567 |
| 4,665,012 | 5/1987 | Sugimoto et al. | 430/567 |
| 4,835,095 | 5/1989 | Ohashi et al. | 430/567 |
| 4,937,180 | 6/1990 | Marchetti et al. | 430/567 |
| 4,945,037 | 7/1990 | Saitou et al. | 430/567 |

OTHER PUBLICATIONS

*Research Disclosure*, vol. 308, Dec. 1989, Item 308119, Section I.D.

*Primary Examiner*—Charles L. Bowers, Jr.
*Assistant Examiner*—Janet C. Baxter
*Attorney, Agent, or Firm*—Carl O. Thomas

[57] ABSTRACT

Photographic emulsions are disclosed comprised of radiation sensitive silver iodobromide grains, at least 50 percent of the total projected area of said silver iodobromide grains being accounted for by tabular grains exhibiting a mean tabularity of greater than 5, at least 10 percent of which are comprised of two opposed parallel major crystal faces, a host stratum having an iodide content of at least 4 mole percent, and laminar strata containing less than 2 mole percent iodide interposed between said host stratum and said opposed major crystal faces.

The emulsions are characterized in that each of the laminar strata is comprised of a surface layer forming one of the major surfaces and having a thickness in the range of from 20 to 350 Å and a subsurface layer located immediately beneath and in contact with the surface layer containing a hexacoordination complex of a Group VIII period 4 or 5 metal and at least three cyanide ligands.

17 Claims, 2 Drawing Sheets

FIG. 1
(PRIOR ART)
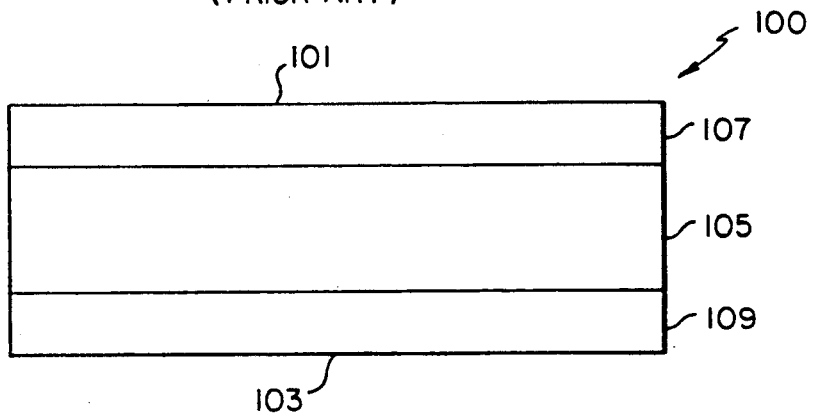
FIG. 2
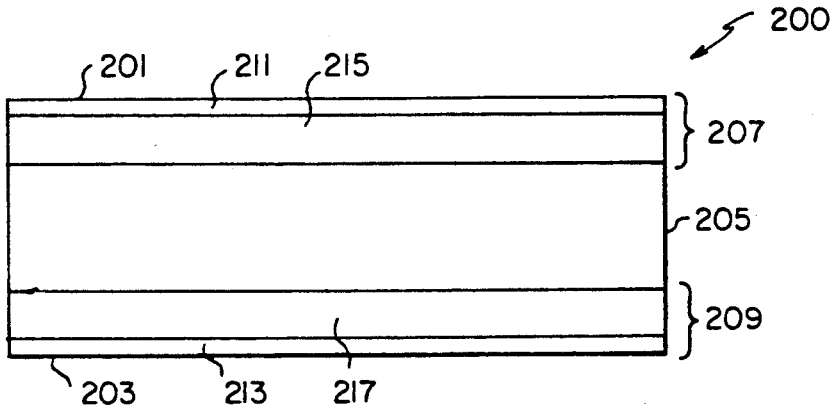
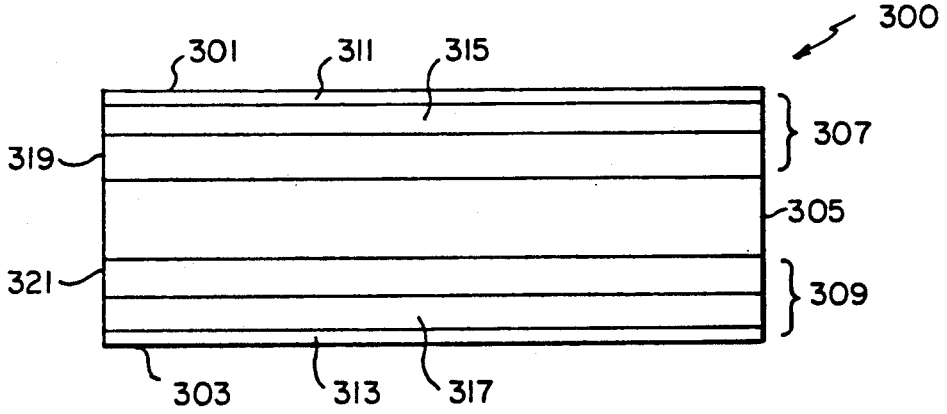
FIG. 3

TABULAR GRAIN EMULSIONS CONTAINING LAMINAR HALIDE STRATA

FIELD OF THE INVENTION

The invention relates to silver halide photography. More specifically, the invention relates to silver halide emulsions.

BACKGROUND OF THE INVENTION

Silver halide photography was well established prior to 1900 as the most desirable approach to obtaining photographic images, based primarily on exceptionally high levels of sensitivity and the capability of producing fine image detail with relatively low levels of noise, referred to in the art as granularity. Silver halide imaging compositions were originally thought to be emulsions, a term that is still used in the art, although it was soon appreciated that the radiation sensitive component of the emulsions were silver halide microcrystals, referred to as grains. From investigations of chloride, bromide and iodide ions in the grains, it was further appreciated that silver iodobromide grains exhibit superior speed-granularity relationships. For this reason, silver iodobromide emulsions are almost universally employed for camera-speed imaging applications. Silver iodobromide grains exhibit the face centered cubic crystal structure of silver bromide with iodide ions being present in minor amounts up to their solubility limit in silver bromide, typically less than 40 mole percent, based on total silver.

Initially the varied shapes of silver iodobromide grains were viewed as more a matter of scientific curiosity than practical significance. It was not until the early 1980's that photographic advantages, such as improved speed-granularity relationships, increased covering power both on an absolute basis and as a function of binder hardening, more rapid developability, increased thermal stability, increased separation of blue and minus blue imaging speeds, and improved image sharpness in both mono- and multi-emulsion layer formats, were realized to be attainable from silver iodobromide emulsions in which the majority of the total grain population based on grain projected area is accounted for by tabular grains exhibiting a high tabularity (T)—that is, greater than 25 when T is defined by the relationship:

$$T = ECD/t^2 \quad (1)$$

where

ECD is the effective circular diameter in $\mu$m of the tabular grains and t is the thickness in $\mu$m of the tabular grains. Wilgus et al U.S. Pat. No. 4,434,226 and Kofron et al U.S. Pat. No. 4,439,520 are illustrative of early discoveries of high tabularity silver iodobromide emulsions and their advantageous photographic characteristics. More recently it has been recognized that thicker tabular grains, sometimes referred to as "slabular" grains, having aspect ratios (ECD/t) down to 2:1 and tabularities ranging upwardly from just to greater than 5 retain to at least some degree the advantages of high tabularity emulsions.

Still more recently it is has been recognized that further improvements in speed-granularity relationships can be realized by constructing tabular iodobromide grains with laminar strata differing in iodide concentrations. Sugimoto et al U.S. Pat. No. 4,665,012, Ohashi et al U.S. Pat. No. 4,835,095 and Saitou et al U.S. Pat. No. 4,945,037 are illustrative of silver iodobromide tabular grains emulsion containing laminar halide strata. In these emulsions advantages have been observed when at least 10 percent of the tabular iodobromide grains are formed of a host stratum having a relatively high iodide content while laminar strata interposed between the host stratum and the major surfaces of the tabular grains contain a relatively low iodide content. The laminar strata of the grains are typically of uniform composition.

It has long been recognized that metals can be incorporated in silver iodobromide emulsions as dopants to modify photographic properties. This is illustrated by *Research Disclosure*, Vol. 307, Dec. 1989, Item 308119, Section I.D. Research Disclosure is published by Kenneth Mason Publications, Ltd., Dudley Annex, 21a North Street, Emsworth, Hampshire PO10 7DQ, England.

Marchetti et al U.S. Pat. No. 4,937,180 recognized that formation of silver iodobromide grains in the presence of a hexacoordination complex of rhenium, ruthenium, or osmium with at least four cyanide ligands would increase the stability of the emulsions and reduce low intensity reciprocity failure. Marchetti et al recognized that the cyanide ligands were incorporated in the grain structure.

Shiba et al U.S. Pat. No. 3,790,390, Ohkubo et al U.S. Pat. No. 3,890,154, and Habu et al U.S. Pat. No. 4,147,542 disclose emulsions particularly adapted to imaging with flash (less than $10^{-5}$ second) exposures. Polymethine cyanine and merocyanine dyes are disclosed having up to three methine groups joining their nuclei, with blue flash exposures being suggested with zero, one or two methine linking groups and green flash exposures being suggested with three methine linking groups. In addition to the dyes it is suggested to incorporate in the emulsions compounds of Group VIII metals—i.e., iron, cobalt, nickel, ruthenium, rhodium, palladium, osmium, iridium and platinum. Iron compounds suggested for incorporation are ferrous sulfate, ferric chloride, potassium hexacyanoferrate (II) or (III), and ferricyanide. Shiba et al, Ohkubo et al, and Habu et al suggest incorporation of the iron compounds at any convenient stage from precipitation to coating, indicating that whether the iron is located within or exterior of the grains is inconsequential to the utility taught.

SUMMARY OF THE INVENTION

In one aspect this invention is directed to a photographic emulsion comprised of radiation sensitive silver iodobromide grains. At least 50 percent of the total projected area of the silver iodobromide grains is accounted for by tabular grains exhibiting a mean tabularity of greater than 5, at least 10 percent of which are comprised of two opposed parallel major crystal faces, a host stratum having an iodide content of at least 4 mole percent, and laminar strata containing less than 2 mole percent iodide interposed between the host stratum and the opposed major crystal faces.

The emulsions are characterized in that each of the laminar strata is comprised of a surface layer forming one of the major surfaces and having a thickness in the range of from 20 to 350 Å and a subsurface layer located immediately beneath and in contact with the surface layer containing a hexacoordination complex of a Group VIII period 4 or 5 metal and at least three cyanide ligands.

It has been discovered quite unexpectedly that hexacoordination complexes of a transition metal and at least three cyanide ligands when incorporated in the relatively low iodide laminar strata of a tabular silver iodobromide grain structure at a location near, but separated from, the major surfaces of the grain, produce increased surface sensitivities.

In addition, reductions in high intensity reciprocity failure are realized. Since exposure (E) is the product of exposure intensity (I) and time (ti), high intensity reciprocity failure is a phenomenon associated with relatively short exposure times of less than $10^{-2}$ second to one ten thousandth of a second ($10^{-5}$ second) or less. High intensity reciprocity failure is observed when numerically equal values of E which are the product of different I and ti combinations produce significantly different photographic responses.

BRIEF DESCRIPTION OF THE DRAWINGS

FIG. 1 is a schematic edge view of a conventional halide strata tabular grain.

FIG. 2 is a schematic edge view of one form of a halide strata tabular grain satisfying the requirements of the invention.

FIG. 3 is a schematic edge view of a second form of a halide strata tabular grain satisfying the requirements of the invention.

Since mean ECDs of tabular grains used for photographic applications do not exceed 10 micrometers (μm) and grain thicknesses are in all instances less than one half grain diameters, typically a much smaller fraction, FIGS. 1 to 3 are not drawn to scale, either in an absolute or relative sense.

DESCRIPTION OF PREFERRED EMBODIMENTS

Figure 4:
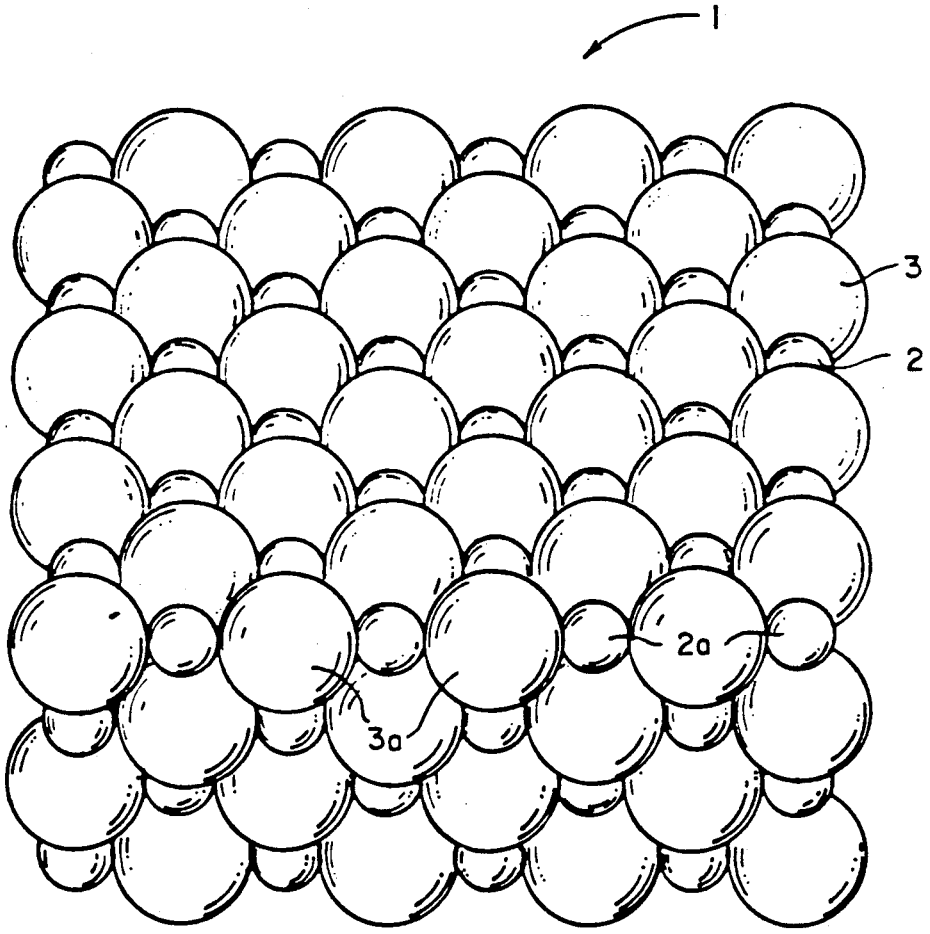
FIG. 4 is a schematic view of a silver bromide crystal structure with the upper layer of ions lying along a {100} crystallographic plane. The sizes of the silver and bromide ions, though enlarged, are accurate in relation to each other.

In FIG. 1 a conventional silver iodobromide tabular grain 100 have opposed parallel major faces 101 and 103 is shown. The major grain faces lie in {111} crystal planes. The grain consists of a host stratum 105 having a relatively high iodide level and laminar strata 107 and 109 separating the host stratum from the major faces 101 and 103, respectively. The laminar strata contain relatively low concentrations of iodide as compared to the host stratum and can be substantially free of iodide ion, if desired. In other words, the laminar strata can consist essentially of silver bromide, if desired.

In one form the emulsions of this invention can contain tabular silver iodobromide grains of the form shown in FIG. 2. The tabular silver iodobromide grain 200 also has opposed parallel major faces 201 and 203 lying in {111} crystal planes. The grain consists of a host stratum 205 having a relatively high iodide level and laminar strata 207 and 209 separating the host stratum from the major faces 201 and 203, respectively. The laminar strata contain relatively low concentrations of iodide as compared to the host stratum and can be substantially free of iodide ion, if desired. In other words, the halide ions of the laminar strata can consist essentially of silver bromide, if desired.

The laminar strata 207 and 209 are each divided into separate layers. The laminar stratum 207 is shown formed of a surface layer 211 lying along and forming the first major surface while the laminar stratum 209 is shown formed of a surface layer 213 lying along and forming the second major surface. Underlying and in direct contact with the surface layers 211 and 213 are subsurface layers 215 and 217, respectively. The significant difference, aside from location, between the surface layers and the subsurface layers is that the subsurface layers are and the surface layers are not doped with a transition metal coordination complex to provide shallow electron traps.

When tabular grains 100 and 200 are identically exposed to electromagnetic radiation of a wavelength capable of absorption, each forms a latent image with a high degree of efficiency, both offering the advantages known to be obtainable from their high tabularity and iodide stratification.

The tabular grain 200 exhibits a higher level of sensitivity in latent image formation than the tabular grain 100. This can be translated into an improved speed-granularity relationship. From experimental investigation it has been determined that the performance improvements observed are attributable to the following factors:

(1) the incorporation of the entire transition metal hexacoordination complex including its cyanide ligands within the grain structure;

(2) location of the hexacoordination complex close to but just beneath the major faces of the tabular grains; and (3) location of the hexacoordination complex in a grain region that exhibits a relatively low iodide level.

In view of factor (3) an alternative and preferred tabular grain structure is shown in FIG. 3. The tabular iodobromide grain 300 also has opposed parallel major faces 301 and 303 lying in {111} crystal planes and a host stratum 305 having a relatively high iodide level which can be identical to those of tabular grain 200. The laminar strata 307 and 309 separate the core stratum from the major faces 301 and 303, respectively. The laminar strata contain relatively low concentrations of iodide as compared to the host stratum and can be substantially free of iodide ion, if desired. In other words, the halide ions of the laminar strata can consist essentially of silver bromide, if desired.

The laminar strata 307 and 309 are each divided into separate layers, wherein surface layers 311 and 313 can be identical to surface layers 211 and 213 and subsurface layers 315 and 317 can be identical to subsurface layers 215 and 217. In addition, the laminar stratum 307 includes an isolation layer 319 interposed between its subsurface layer 315 and the host stratum 305, and the laminar stratum 309 includes an identical isolation layer 321 interposed between its subsurface layer 317 and the host stratum. The role of each of the isolation strata is to protect the subsurface layer from iodide ion that might otherwise enter the subsurface layer from the relatively high iodide level host stratum. All of the laminar strata layers can be conveniently formed by restricting iodide to the desired low level in the salts being added during precipitation. If additional iodide diffuses into the isolation layer from the host stratum during or following precipitation, this does not adversely affect tabular grain performance, provided the iodide levels in the surface and subsurface layers remain relatively low. In one preferred form only silver and bromide ions are used to precipitate the isolation layers, thereby minimizing iodide incorporation in these layers.

In preparing the tabular grains required for the emulsions of this invention a conventional relatively high iodide iodobromide tabular grain emulsion can be used as a starting material to provide the host stratum. The host stratum typically constitutes from 20 to 80 percent of the total volume of the grains after laminar strata have been deposited to form the tabular grains of the invention. Since the laminar strata thicken the grains without proportionately increasing their ECD, the tabular grain emulsion is chosen to provide the host strata must have a mean tabularity that is greater than that of the fully formed halide strata tabular grains. The required mean tabularity of the host strata tabular grain emulsion can be calculated from a knowledge of the proportion of total silver it constitutes and the desired tabularity of the fully formed halide strata tabular grains.

The iodide content of the tabular grains forming the host strata can conform to that of the relatively high iodide portion of any conventional halide strata iodobromide tabular grains. For example, the host stratum iodide level of any one of Sugimoto et al U.S. Pat. No. 4,665,012, Ohashi et. al. U.S. Pat. No. 4,835,095 and Saitou et. al. U.S. Pat. No. 4,945,037, cited above and here incorporated by reference, can be employed. That is, the iodide content of the host stratum can range as low as 4 mole percent, based on total silver in the host stratum. It is preferred that the host stratum exhibit an iodide concentration of at least 6 mole percent, based on total silver in the host stratum. Iodide levels up to the solublity limit of iodide ion in silver bromide, up to about 40 mole percent, depending upon the temperature of preparation, are contemplated.

It is preferred that the emulsions of the invention exhibit an overall tabular grain iodide content in the range of from 0.1 to 20 mole percent for most photographic applications, optimally from about 1 to 10 mole percent. Depending upon the percentage of the total halide strata tabular grains formed by the host strata and the percentage of the halide strata tabular grains making up the total tabular grain population, it is apparent that a wide range of host strata iodide level selections are possible. Although not required, it is usually preferred that when halide strata tabular grain populations are blended with other tabular grain populations to achieve a particular imaging aim characteristic, that the grain populations have relatively similar, preferably the same overall tabular grain iodide content.

When the halide strata tabular grains include isolation layers, the preferred next step in preparation is to precipitate silver bromide on the major faces of the tabular-grains providing the host strata. By forming the isolation layers of silver bromide maximum protection is afforded in keeping the iodide level of the laminar strata relatively low in relation to that of the host strata. If iodide is included in the isolation layers, it is limited to less than 2 mole percent, based on total silver in these layers. If the iodide level is raised to a still higher level, the isolation layers cease to be viewed as part of the laminar strata and are instead viewed as an extension of the host strata.

The surface and subsurface layers of the halide strata tabular grains are formed on the major faces of the tabular grains providing the host strata. These layers are deposited over the isolation layers, if present. The surface and subsurface layers are formed by precipitating silver bromide or iodobromide. However, if iodide is included it is limited to less than 2 mole percent, preferably less than 1.5 mole percent, and optimally less than 1.0 mole percent. All percentages are based on total silver in these layers. In some modes of preparation the iodide level increases progressively with increasing depth measured from the grain surface. Any underlying portion of the subsurface layer having an iodide content of 2 mole percent or greater is viewed as being part of the host stratum.

As the subsurface layers are formed, a hexacoordination complex of a transition metal and at least three cyanide ligands is coprecipitated with the silver halide. By proper choice of the transition metal the complex formed with the cyanide ligands is capable of providing shallow electron trapping sites in the grains. When a photon is absorbed by a silver iodobromide grain or a spectral sensitizing dye adsorbed on its surface, a hole-electron pair is created that releases a mobile electron within the grain crystal structure. A developable latent image is produced when enough $Ag^{\circ}$, produced by photogenerated electron reduction of silver ions, is produced at one location in the grain to catalyze grain development. Competing with the useful $$Ag^{+} + e \rightarrow Ag^{\circ}$$

reaction is recombination of the photogenerated hole and electron. In grains doped according to the requirements of the invention the photogenerated electron is momentarily held at a shallow electron trapping site. At sufficiently high concentrations of shallow electron trapping sites there is a high probability that once the electron is released from a shallow trapping site, it will be momentarily retrapped at a nearby electron trapping site. In this way, the amount of time that the mobile electron spends in one vicinity within the grain is increased and the probability of the mobile electron participating in latent image formation as opposed to recombination with a hole is also increased. Every photogenerated electron that is saved in this manner for latent image formation increases the sensitivity of the emulsion. Shallow electron traps only briefly interrupt the migration of the photogenerated electron and are to be distinguished from deep electron traps that permanently immobilize the electron. Iridium ions replacing silver ions in a silver halide crystal structure are known to form deep electron traps.

A preferred class of hexacoordination complexes of transition metals capable of forming sensitivity enhancing shallow electron trapping sites are hexacoordination complexes of a Group VIII period 4 or 5 metal and at least three cyanide ligands. Such complexes can be represented by the formula:

(II)

$$[M(CN)_{6-y}L_y]^n \quad (11)$$

where

M is a transition metal chosen from one of periods 4 and 5 of Group VIII,

L is a bridging ligand, y is the integer zero, 1, 2 or 3 and n is -2, -3, or -4.

Preferred transition metals are iron, ruthenium and rhodium.

Marchetti et al U.S. Pat. No. 4,937,180, cited above, demonstrated that transition metal complexes with cyanide ligands are incorporated intact in a silver halide face centered cubic crystal lattice structure, and further investigations of complexes satisfying formula (II) have confirmed this determination. The entire hexacoordinated cyanide ligand complex is incorporated intact in the grains being formed. To understand how this can be possible, it is helpful to first review the structure of silver halide grains. Unlike silver iodide, which commonly forms only $\beta$ and $\gamma$ phases and is rarely used in photography, each of silver chloride and silver bromide form a face centered cubic crystal lattice structure of the rock salt type. In FIG. 4 four lattice planes of a crystal structure 1 of silver ions 2 and bromide ions 3 is shown, where the upper layer of ions lies in a {100} crystallographic plane. The four rows of atoms shown counting from the bottom of FIG. 4 lie in a {100} crystallographic plane which perpendicularly intersects the {100} crystallographic plane occupied by the upper layer of ions. The row containing silver ions 2*a* and bromide ions 3*a* lies in both intersecting planes. In each of the two {100} crystallographic planes it can be seen that each silver ion and each bromide ion lies next adjacent to four bromide ions and four silver ions, respectively. In three dimensions then, each interior silver ion lies next adjacent to six bromide ions, four in the same {100} crystallographic plane and one on each side of the plane. A comparable relationship exists for each interior bromide ion.

The manner in which a hexacoordinated transition metal complex can be incorporated in the grain structure can be roughly appreciated by considering the characteristics of a single silver ion and six adjacent halide ions (hereinafter collectively referred to as the seven vacancy ions) that must be omitted from the crystal structure to accommodate spatially the hexacoordinated complex. The seven vacancy ions exhibit a net charge of -5. This suggests that anionic complexes should be more readily incorporated in the crystal structure than neutral or cationic transition metal complexes. This also suggests that the capability of a hexacoordinated complex to trap either photogenerated holes or electrons may be determined to a significant degree by whether the complex introduced has a net charge more or less negative than the seven vacancy ions it displaces. This is an important departure from the common view that transition metals are incorporated into silver halide grains as bare ions or atoms and that their hole or electron trapping capability is entirely a function of their oxidation state.

Referring to FIG. 4, it should be further noted that the silver ions are much smaller than the bromide ions, though silver lies in the 5th period while bromine lies in the 4th period. Further, the lattice is known to accommodate iodide ions (in concentrations of up to 40 mole percent, noted above) which are still larger than bromide ions. Thus, the 4th and 5th period transition metal ions are small enough to enter the lattice structure with ease. A final observation that can be drawn from the seven vacancy ions is that the six halide ions exhibit an ionic attraction not only to the single silver ion that forms the center of the vacancy ion group, but are also attracted to other adjacent silver ions.

Hexacoordinated complexes exhibit a spatial configuration that is compatible with the face centered cubic crystal structure of photographically useful silver halides. The six ligands are spatially comparable to the six halide ions next adjacent to a silver ion in the crystal structure. To appreciate that a hexacoordinated complex having ligands other than halide ligands can be accommodated into silver halide cubic crystal lattice structure it is necessary to consider that the attraction between the transition metal and its ligands is not ionic, but the result of covalent bonding, the latter being much stronger than the former. Since the size of a hexacoordinated complex is determined not only by the size of the atoms forming the complex, but also by the strength of the bonds between the atoms, a hexacoordinated complex can be spatially accommodated into a silver halide crystal structure in the space that would otherwise be occupied by the seven vacancy ions, even though the numbers and/or diameters of the individual atoms forming the complex exceeds that of the vacancy ions. This is because the covalent bond strength can significantly reduce the bond distances and therefore the size of the entire complex. Thus, the multielement ligands of hexacoordinated complexes can be spatially accommodated to single halide ion vacancies within the crystal structure.

Hexacoordination complexes satisfying the requirements of this invention are those which contain transition metal and 3, 4, 5 or 6 cyanide ligands. When less than 6 cyanide ligands are employed, the remaining ligands or ligand can be any convenient conventional bridging ligand. The latter when incorporated in the silver halide crystal structure are capable of serving as bridging groups between two or more metal centers. These bridging ligands can be either monodentate or ambidentate. A monodentate bridging ligand has only one ligand atom that forms two (or more) bonds to two (or more) different metal atoms. For monoatomic ligands and for those containing only one donor atom, only the monodentate form of bridging is possible. Multielement ligands with more than one donor atom can also function in a bridging capacity and are referred to as ambidentate ligands. Preferred bridging ligands are monoatomic monodentate ligands, such as halides. Fluoride, chloride, bromide and iodide ligands are all specifically contemplated. Multielement ligands, such as azide and thiocyanate ligands, are also specifically contemplated. Bridging ligands can be selected from among those disclosed for the transition metals disclosed by Janusonis et al U.S. Pat. No. 4,835,093, McDugle et al U.S. Pat. No. 4,933,272, Marchetti et al U.S. Pat. No. 4,937,180 and Keevert et al U.S. Pat. No. 4,945,035, the disclosures of which are here incorporated by reference. Bridging ligands which are desensitizers should, of course, be avoided.

Any net ionic charge exhibited by the hexacoordinated iron complexes contemplated for grain incorporation is compensated by a counter ion to form a charge neutral compound. The counter ion is of little importance, since the complex and its counter ion or ions dissociate upon introduction into an aqueous medium, such as that employed for silver halide grain formation. Ammonium and alkali metal counterions are particularly suitable for anionic hexacoordinated complexes satisfying the requirements of this invention, since these cations are known to be fully compatible with silver halide precipitation procedures.

Although the foregoing explanation of incorporation has been directed to hexacoordination complexes, essentially the same considerations apply to tetracoordination complexes. It is recognized that stable tetracoordination complexes capable of forming shallow electron traps can, if desired, be substituted for hexacoordination complexes. Tetracoordination complexes contain only four ligands, at least three of which are contemplated to be cyanide ligands.

The hexacoordination complexes are incorporated in the subsurface layers in a concentration of less than 0.2 (preferably less than 0.1) percent, based on silver in the subsurface layers. Preferred hexacoordination complex concentrations, particularly when the complexes of formula (II) are employed, are in the range of from $2.5\times10^{-3}$ to $5\times10^{-2}$ mole percent, based on silver in the subsurface layers.

The thickness of the subsurface layers is not critical. Any subsurface layer thickness capable of insuring an substantially uniform distribution of the incorporated complex in the laminar stratum is acceptable. Typically a subsurface layer thickness of at least 100 Å is contemplated, with a subsurface layer thickness of at least 200 Å being preferred. Generally no advantage is realized from using more than about 20 percent of the total silver to form the subsurface layers. However, when the host stratum accounts for a minimum 20 percent of total grain silver and no separate isolation layers are incorporated, the subsurface layers can account for nearly 80 percent of the total silver forming each halide strata tabular grain, since very little of the total silver is required to form the surface layers.

It has been determined experimentally that the hexacoordination complexes are effective to increase grain sensitivity and speed-granularity relationships when the hexacoordination complexes are present in the grain just below the surface of the grains. If the hexacoordination complex is either too deep or at the surface of the grains, the advantages of the invention are not fully realized. Based on these observations it has been concluded that the thickness of the surface layer must be in the range of from 20 to 350 Å, preferably from 25 to 100 Å.

While the art of metal doping silver halide grains has assigned little, if any, importance to the internal placement of dopants and has, in fact, in many instances equated dopant additions prior, during and after precipitation, it has been recognized that it is the close proximity of the hexacoordination complexes to, but absence from, the tabular grain major surfaces that is important to realizing the advantages of the invention.

A possible explanation for the importance of this placement of the coordination complexes in the tabular grains is as follows: Unless specifically modified to form internal latent images, silver halide grains generally and iodobromide grains in particular form predominantly surface latent images. The foregoing discussions of sensitivity and speed are used in their customary sense to mean surface sensitivity and surface speed. Placing an electron trapping agent at the surface of a tabular grain would be expected to interfere with the electron mobility required for surface latent image formation. Thus, the surface layers of the tabular grains are preferably substantially free of the hexacoordination complexes.

Looking at the other extreme, as the hexacoordination complexes are progressively more deeply buried within the grains, the propensity for photogenerated electrons released from the hexacoordination complexes to form surface latent image is diminished by the increased distances the released electron traverse to reach the grain surface. Hence there is an optimum depth within the grains for the shallow electron trapping dopants. Since photoelectrons are in most instances injected into the grains from adsorbed spectral sensitizing dye, it is the depth from the surface at which the hexacoordination complex is first encountered that is controlling.

In addition to increasing sensitivity, reduced variation of photographic characteristics as a function of numerically identical exposure levels at exposure times ranging from less than $10^{-2}$ to $10^{-5}$ seconds or less (i.e., reduced high intensity reciprocity failure) can be realized with the emulsions of this invention.

The emulsions of the invention are comprised of radiation sensitive silver iodobromide grains. At least 50 percent of the total projected area of the silver iodobromide grains is accounted for by tabular grains exhibiting a mean tabularity of greater than 5, where tabularity is as defined by relationship (I) above. The emulsions of the invention preferably exhibit at tabularity of greater than 8 and optimally high tabularity—that is T greater than 25.

The tabular grains can exhibit any conventional mean ECD ranging up to about 10 μm, but typically less than 5 μm, and most commonly less than 2 μm. Since the minimum thicknesses of the surface and subsurface layers are measured in Angstroms, they need not significantly increase the thicknesses of the tabular grains. Thus, the tabular grains can exhibit any conventional mean thickness. The tabular grain emulsions of this invention preferably exhibit thicknesses of less than 0.3 μm and optimally less than 0.2 μm. Emulsions intended for exposure in regions of native spectral sensitivity can advantageously exhibit mean thicknesses of up about 0.5 μm. The tabular grains can have mean ECDs down to 0.2 μm or less and mean thicknesses down to 0.01 μm. Examples of silver iodobromide tabular grain emulsions with low ECDs and thicknesses are provided by Daubendiek et. al. U.S. Pat. No. 4,672,027, the disclosure of which is here incorporated by reference. In general the silver iodobromide tabular grains have mean aspect ratios (ECD/t) of at least 5, preferably greater than 8 and typically greater than 20. Mean aspect ratios of up to 100 are common with mean aspect ratios of 200 or more being attainable.

The advantages of high tabularity are realized when the silver iodobromide tabular grains account for greater than 50 percent of the total grain projected area. Preferably the silver iodobromide tabular grains account for greater than 70 percent of the total grain projected and optimally greater than 90 percent of the total grain projected area.

In preparing halide strata tabular grains of the structures shown schematically in FIGS. 2 and 3, all or substantially all of the tabular grains exhibit at the conclusion of precipitation the strata described above. The advantages which the novel halide strata tabular grains provide does not, however, require that all silver iodobromide tabular grains in an emulsion exhibit this structure. Generally the advantages of the invention are detectable when at least about 10 percent of the silver iodobromide tabular grains exhibit the layer structure shown in FIGS. 2 or 3. Thus, as actually used in photographic products the novel iodobromide tabular grains can be blended with conventional iodobromide tabular grains to satisfy the requirements of a specific photographic application. For example, Newmiller U.S. Pat. No. 4,865,964 suggests blending high aspect ratio tabular grains with low aspect ratio grains. For simplicity of preparation it is preferred to employ emulsions in which all of the silver iodobromide tabular grains required to satisfy tabularity and projected area requirements exhibit one of the layer structures shown in FIGS. 2 and 3. To obtain greater advantages from the tabular grains of the invention, it is preferred that the silver iodobromide grains exhibiting the novel structure of the invention account for at least 50 percent of the tabular grains present in the emulsion on a projected area basis.

Although the emulsions have been described in terms of silver iodobromide tabular grains, it is appreciated that other silver salts can be present in the emulsions. For example, it is well known for specific imaging applications to blend grains of differing silver halide composition. Dickerson U.S. Pat. No. 4,520,098 teaches to blend fine silver iodide grains with tabular grains to reduce dye stain. Maskasky U.S. Pat. No. 4,435,501 teaches to add small amounts of silver thiocyanate, silver chloride or silver bromide to silver iodobromide tabular grain emulsions to increase sensitivity. It is specifically contemplated that, if desired, the tabular iodobromide grains can contain small amounts of silver chloride, particularly in the surface layer or as an edge or corner epitaxial deposit, to enhance sensitivity or development rates.

Apart from the emulsion features described above, the emulsions and photographic elements for their use can take any of a wide variety of conventional forms. These features are surveyed in *Research Disclosure*, Item 308119, cited above and here incorporated by reference.

The additional increment of sensitivity imparted by the cyanide ligand coordination complex can be used to advantage to offset desensitization attributable to the presence of spectral sensitizing dyes, commonly employed to record exposures to electromagnetic radiation having wavelengths longer than about 450 nm. The emulsions of the invention can be used to advantage with all classes of dyes known to be spectral sensitizers, including the polymethine dye class, which includes the cyanines, merocyanines, complex cyanines and merocyanines (i.e., tri-, tetra- and polynuclear cyanines and merocyanines), oxonols, hemioxonols, styryls, merostyryls and streptocyanines.

The most widely employed spectral sensitizing dyes are the cyanine class of dyes. Cyanine spectral sensitizing dyes include, joined by a methine linkage, two basic heterocyclic nuclei, such as those derived from quinolinium, pyridinium, isoquinolinium, 3H-indolium, benz[e]indolium, oxazolium, thiazolium, selenazolinium, imidazolium, benzoxazolinium, benzothiazolium, benzoselenazolium, benzimidazolium, naphthoxazolium, naphthothiazolium, naphthoselenazolium, thiazolinium, dihydronaphthothiazolium, pyrylium and imidazopyrazinium quaternary salts. The basic heterocyclic nuclei can also include tellurazoles or oxatellurazoles as described by Gunther et al U.S. Pats. Nos. 4,575,483, 4,576,905 and 4,599,410. The methine linkage of cyanine dyes contain a single methine group in simple cyanine dyes, three methine groups in carbocyanine dyes and five, seven, nine, etc. methine groups in higher homologues. A portion of the methine linking unit of the dyes can be cyclized, particularly in the more extended methine linking units. It is also well recognized that one or more of methine groups can be replaced by an aza (—N=) linking group.

The merocyanine spectral sensitizing dyes include, joined by a methine linkage, a basic heterocyclic nucleus of the cyanine-dye type and an acidic nucleus such as can be derived from barbituric acid, 2-thiobarbituric acid, rhodanine, hydantoin, 2-thiohydantoin, 4-thiohydantoin, 2-pyrazolin-5-one, 2-isoxazolin-5-one, indan-1,3-dione, cyclohexan-1,3-dione, 1,3-dioxane-4,6-dione, pyrazolin-3,5-dione, pentan-2,4-dione, alkylsulfonyl acetonitrile, malononitrile, isoquinolin-4-one, and chroman-2,4-dione. The merocyanine dyes may include telluracyclohexanedione as acidic nucleus as described in Japanese Patent Application JA 51/136,420. Simple merocyanines contain a double bond linkage of their nuclei, dimethine merocyanines have two methine groups linking their nuclei. Tetramethine merocyanines and higher homologues are known.

One or more spectral sensitizing dyes may be used. The choice and relative proportions of dyes depends upon the region of the spectrum to which sensitivity is desired and upon the shape of the spectral sensitivity curve desired. Dyes with overlapping spectral sensitivity curves will often yield in combination a curve in which the sensitivity at each wavelength in the area of overlap is approximately equal to the sum of the sensitivities of the individual dyes. Thus, it is possible to use combinations of dyes with different maxima to achieve a spectral sensitivity curve with a maximum intermediate to the sensitizing maxima of the individual dyes.

Combinations of spectral sensitizing dyes can be used which result in supersensitization—that is, spectral sensitization greater in some spectral region than that from any concentration of one of the dyes alone or that which would result from the additive effect of the dyes. Supersensitization can be achieved with selected combinations of spectral sensitizing dyes and other addenda such as stabilizers and antifoggants, development accelerators or inhibitors, coating aids, brighteners and antistatic agents. Any one of several mechanisms, as well as compounds which can be responsible for supersensitization, are discussed by Gilman, *Photographic Science and Engineering*, Vol. 18, 1974, pp. 418–430.

The chemistry of cyanine and related dyes is illustrated by Weissberger and Taylor, *Special Topics of Heterocyclic Chemistry*, John Wiley and Sons, New York, 1977, Chapter VIII; Venkataraman, *The Chemistry of Synthetic Dyes*, Academic Press, New York, 1971, Chapter V; James, *The Theory of the Photographic Process*, 4th Ed., Macmillan, 1977, Chapter 8, and F. M. Hamer, *Cyanine Dyes and Related Compounds*, John Wiley and Sons, 1964.

Among useful spectral sensitizing dyes for sensitizing the emulsions of this invention are those found in U.K. Pat. No. 742,112, Brooker U.S. Pats. Nos. 1,846,300, '301, '302, '303, '304, 2,078,233 and 2,089,729, Brooker et al U.S. Pats. Nos. 2,165,338, 2,213,238, 2,493,747, '748, 2,526,632, 2,739,964 (Reissue 24,292), 2,778,823, 2,917,516, 3,352,857, 3,411,916 and 3,431,111, Sprague U.S. Pat. No. 2,503,776, Nys et al U.S. Pat. No. 3,282,933, Riester U.S. Pat. No. 3,660,102, Kampfer et al U.S. Pat. No. 3,660,103, Taber et al U.S. Pats. Nos. 3,335,010, 3,352,680 and 3,384,486, Lincoln et al U.S. Pat. No. 3,397,981, Fumia et al U.S. Pats. Nos. 3,482,978 and 3,623,881, Spence et al U.S. Pats. Nos. 3,718,470 and Mee U.S. Pat. No. 4,025,349. Examples of useful supersensitizing-dye combinations, of non-light-absorbing addenda which function as supersensitizers or of useful dye combinations are found in McFall et al U.S. Pat. No. 2,933,390, Jones et al U.S. Pat. No. 2,937,089, Motter U.S. Pat. No. 3,506,443 and Schwan et al U.S. Pat. No. 3,672,898.

It is contemplated to add the spectral sensitizing dyes to the emulsions at any convenient stage following precipitation of the surface layer portion of the grains. Spectral sensitizing dyes and their addition are described in Research Disclosure Item 308119, cited above, Section IV.

The term "effective circular diameter" or "ECD" is used to indicate the diameter of a circle having an area equalling the projected area of the grain. The term "projected area" is employed in its art recognized usage, as explained by Wilgus et al and Kofron et al, cited above.

EXAMPLES

The invention can be better appreciated by reference to the following specific examples.

EXAMPLES 1-7

A series of silver iodobromide tabular grain emulsions were prepared for comparison in which the tabular grains in each instance exhibited a mean ECD of 0.73 μm, a mean thickness of 0.176 μm, and a mean tabularity of 23.6. Iron hexacyanide was added in a concentration of $5\times10^{-2}$ mole percent to the layers formed in its presence.

EXAMPLE 1

A tabular grain host emulsion with halide composition of 6% iodide and 94% bromide was prepared as described below.

A reaction vessel containing 4.54 liters of a 0.25 percent by weight oxidized gelatin aqueous solution was adjusted to a temperature of 35° C., pH of 1.89, and a pAg of 9.57 by addition of NaBr solution. A 1.25 molar solution containing 5.1 g $AgNo_3$ in water (24 ml total volume) and a 1.25 molar solution of 6 percent iodide salt solution, based on total halide, containing 2.9 g NaBr and 0.3 g KI in water (24 ml total volume), were simultaneously run into the reaction vessel each at a constant flow rate of 110 ml/min.

This double run was continued for 14 seconds until the silver nitrate and halide salt solutions had been completely added. The reaction vessel was then heated to 60° C. and 861 ml of a 16.8 percent by weight oxidized gelatin aqueous solution added. The pH was then adjusted to 6.0, and the pAg to 8.90 by addition of NaBr solution. At this point a 1.2 molar solution of $AgNO_3$ in water and a 1.2 molar solution of NaBr in water were simultaneously run into the reaction vessel at a flow rate which increased linearly from 48 ml/min to 60 ml/min. Concurrently a 0.0766 molar Lippmann silver iodide emulsion was added at a flow rate which increased linearly from 49.7 ml/min to 62.1 ml/min.

This triple run was continued for 34.5 minutes under controlled pAg (8.90) conditions. At this point a 1.2 molar solution of $AgNO_3$ in water and a 1.2 molar solution of NaBr in water were simultaneously run into the reaction vessel at a flow rate which increased linearly from 60 ml/min to 110 ml/min. Concurrently a 0.0766 molar Lippmann silver iodide emulsion was added at a flow rate which increased linearly from 62.1 ml/min to 113.8 ml/min.

This triple run was continued for 21.9 minutes under controlled pAg (8.90) conditions. At this point the emulsion was washed by ultrafiltration. The resulting concentrated emulsion was then redispersed into a gelatin solution at a pH of 5.4 and a pAg of 8.3.

The resultant host emulsion consisted of high aspect ratio tabular grains with an average grain diameter of 0.69 μm (ECD) and an average thickness of 0.048 μM.

To a reaction vessel containing 200 ml of distilled water were added 0.125 moles of pure silver bromoiodide tabular grain host emulsion described above. The reaction vessel was then heated to 60° C. and the pAg of the emulsion was adjusted to a value of 7.92 by the addition of AgBr solution. A 1.75 molar solution containing 8.85 g of $AgNO_3$ in water (29.8 ml total volume) and a 1.75 molar aqueous solution of NaBr were simultaneously run into the reaction vessel each at a constant flow rate of 0.985 ml/min.

This double run was continued for 30.21 minutes under controlled pAg (7.92) conditions. At this point a 1.75 molar solution containing 44.3 g of $AgNO_3$ in water (1.49 ml total volume) and a 1.75 molar solution of a 0.05 mole percent ferrocyanide solution, based on total anion content, consisting of 37.2 g of NaBr and 0.0659 g of $K_4Fe(CN)_6$ in water (206.5 ml total volume) were simultaneously run into the reaction vessel each at a constant flow rate of 1.97 ml/min.

This double run was continued for 75.5 minutes under controlled pAg (7.92) conditions. At this point a 1.75 molar solution containing 5.31 g of $AgNO_3$ in water (17.9 ml total volume) and a 1.75 molar aqueous solution of NaBr were simultaneously run into the reaction vessel each at a constant flow rate of 1.97 ml/min.

This double run was continued for 9.06 minutes under controlled pAg (7.92) conditions. At this point phthalated gelatin was added to the reaction vessel and the emulsion was washed twice by this procedure. The resulting coagulated emulsion was then redispersed in a gelatin solution at a pH of 5.5 and a pAg of 8.3.

EXAMPLE 2

To a reaction vessel containing 200 ml of distilled water were added 0.125 moles of pure silver bromoiodide tabular grain host emulsion described above. The reaction vessel was then heated to 60° C. and the pAg of the emulsion was adjusted to a value of 7.92 by the addition of AgBr solution. A 1.75 molar solution containing 8.85 g of $AgNO_3$ in water (29.8 ml total volume) and a 1.75 molar aqueous solution of NaBr were simultaneously run into the reaction vessel each at a constant flow rate of 0.985 ml/min.

This double run was continued for 30.21 minutes under controlled pAg (7.92) conditions. At this point solutions of the above described concentrations were simultaneously run into the reaction vessel at a constant flow rate of 1.97 ml/min.

This double run was continued for 60.42 minutes under controlled pAg (7.92) conditions. At this point a 1.75 molar solution containing 8.85 g $AgNO_3$ in water (29.8 ml total volume) and a 1.75 molar solution of a 0.05 mole percent ferrocyanide solution, based on total anion content, consisting of 14.6 g of NaBr and 0.0259 g of $K_4Fe(CN)_6$ in water (81.3 ml total volume) were simultaneously run into the reaction vessel each at a constant flow rate of 1.97 ml/min.

This double run was continued for 15.1 minutes under controlled pAg (7.92) conditions. At this point a 1.75 molar solution containing 5.31 g $AgNO_3$ in water (17.9 ml total volume) and a 1.75 molar aqueous solution of NaBr were simultaneously run into the reaction vessel each at a constant flow rate of 1.97 ml/min.

This double run was continued for 9.06 minutes under controlled pAg (7.92) conditions. At this point phthalated gelatin was added to the reaction vessel and the emulsion was washed twice by this procedure. The resulting coagulated emulsion was then redispersed in a gelatin solution at a pH of 5.5 and a pAg of 8.3.

Example 3 (A Control)

A control emulsion was prepared following the exact procedures described in Example 2 with the exclusion of ferrocyanide ion from the make.

Example 4

To a reaction vessel containing 200 ml of distilled water were added 0.125 moles of pure silver bromoiodide tabular grain host emulsion described above. The reaction vessel was then heated to 60° C. and the pAg of the emulsion was adjusted to a value of 7.92 by the addition of AgBr solution. A 1.75 molar solution containing 8.85 g of $AgNO_3$ in water (29.8 ml total volume) and a 1.75 molar solution of a 20 mole percent iodide salt solution, based on total halide, containing 11.7 g NaBr and 4.72 g KI in water (81.3 ml total volume) were simultaneously run into the reaction vessel each at a constant flow rate of 0.985 ml/min.

This double run was continued for 30.21 minutes under controlled pAg (7.92) conditions. At this point a 1.75 molar solution containing 44.3 g of $AgNO_3$ in water (149 ml total volume) and a 1.75 molar solution of a 0.05 mole percent ferrocyanide solution, based on total anion content, consisting of 37.2 g of NaBr and 0.0659 g of $K_4Fe(CN)_6$ in water (206.5 ml total volume) were simultaneously run into the reaction vessel each at a constant flow rate of 1.97 ml/min.

This double run was continued for 75.5 minutes under controlled pAg (7.92) conditions. At this point a 1.75 molar solution containing 5.31 g of $AgNO_3$ in water (17.9 ml total volume) and a 1.75 molar aqueous solution of NaBr were simultaneously run into the reaction vessel each at a constant flow rate of 1.97 ml/min.

This double run was continued for 9.06 minutes under controlled pAg (7.92) conditions. At this point phthalated gelatin was added to the reaction vessel and the emulsion was washed twice by this procedure. The resulting coagulated emulsion was then redispersed in a gelatin solution at a pH of 5.5 and a pAg of 8.3.

Example 5 (A Control)

A control emulsion was prepared following the exact procedures described in Example 4 with the exclusion of ferrocyanide ion from the make.

Example 6

To a reaction vessel containing 200 ml of distilled water were added 0.125 moles of pure silver bromoiodide tabular grain host emulsion described above. The reaction vessel was then heated to 60° C. and the pAg of the emulsion was adjusted to a value of 7.92 by the addition of AgBr solution. A 1.75 molar solution containing 8.85 g of $AgNO_3$ in water (29.8 ml total volume) and a 1.75 molar solution of a 20 mole percent iodide salt solution, based on total halide, containing 11.7 g NaBr and 4.72 g KI in water (81.3 ml total volume) were simultaneously run into the reaction vessel at a constant flow rate of 0.985 ml/min.

This double run was continued for 30.21 minutes under controlled pAg (7.92) conditions. At this point a 1.75 molar solution containing 35.4 g of $AgNO_3$ in water (119.0 ml total volume) and a 1.75 molar aqueous NaBr solution were simultaneously run into the reaction vessel at a constant flow rate of 1.97 ml. min.

This double run was continued for 60.42 minutes under controlled pAg (7.92) conditions. At this point a 1.75 molar solution containing 8.85 g $AgNO_3$ in water (29.8 ml total volume) and a 1.75 molar solution of a 0.05 mole percent ferrocyanide solution, based on total anion content, consisting of 14.6 g of NaBr and 0.0259 g of $K_4Fe(CN)_6$ in water (81.3 ml total volume) were simultaneously run into the reaction vessel each at a constant flow rate of 1.97 ml/min.

This double run was continued for 15.1 minutes under controlled pAg (7.92) conditions. At this point a 1.75 molar solution containing 5.31 g of $AgNO_3$ in water (17.9 ml total volume) and a 1.75 molar aqueous solution of NaBr were simultaneously run into the reaction vessel each at a constant flow rate of 1.97 ml/min.

This double run was continued for 9.06 minutes under controlled pAg (7.92) conditions. At this point phthalated gelatin was added to the reaction vessel and the emulsion was washed twice by this procedure. The resulting coagulated emulsion was then redispersed in a gelatin solution at a pH of 5.5 and a pAg of 8.3.

Example 7 (A Control)

Example 6 was repeated, except that the iodide level of the subsurface layer was increased as indicated in Table I and the $[Fe(CN)_6]^{-4}$ dopant was incorporated in the grain at all portions of the tabular grains, except the surface layer, at a concentration of $5\times10^{-2}$ mole percent, based on silver.

Emulsion Sensitization

The cited emulsions were optimally sensitized using 0.71 mmoles total of dyes D-1 and D-2 (3:1 molar ratio), 75 mg/silver mole of NaSCN, 2.2 mg/mole potassium tetrachloroaurate and 5.5 mg/mole of sodium thiosulfate and finished for 10 minutes at 67.5° C.

Dye D-1

Anhydro-5-chloro-9-ethyl-5'-phenyl-3'-(3-sulfobutyl)-3-(3-sulfopropyl)oxacarbocyanine hydroxide, sodium salt Dye D-2

Anhydro-1,1'-bis(3-sulfopropyl)naph[1,2-d]oxazolocarbocyanine hydroxide, sodium salt Coating The emulsions were coated at 8.1 mg/dm$^2$ (75 mg/ft$^2$) of silver halide, 16.1 mg/dm$^2$ (150 mg/ft$^2$) of coupler C-1 with 24.2 mg/dm$^2$ (225 mg/ft$^2$) of gelatin. The emulsion layer is overcoated with 24.2 mg/dm$^2$ (225 mg/ft$^2$) of gelatin hardened at 1.75% bis(vinylsulfonyl)methane, based on the weight of gelatin.

C-1

2-[2,4-Bis(1,1-dimethylpropyl)phenoxy]-N-[4-[[[(4-cyanophenyl)amino]carbonyl]amino-3-hydroxyphenyl]-hexanamide Exposures The coatings were given a 0.01 second exposure at 5500° K. color temperature filtered through a Wratten 9 (trademark) filter to remove wavelengths shorter than 490 nm and a 0–3 neutral density step chart. Separate samples were then processed for 4 minutes in a standard color reversal process, specifically the Kodak E-6 (trademark) process or for 3 minutes 15 seconds in a standard color negative process, specifically the Kodak C-41 (trademark) process. The British Journal of Photography Annual 1988 describes the E-6 process at pp. 194–196 and the C-41 process at pp. 196–198.

Comparisons

Significant differences in the structure of the photographic elements and their comparative performances are shown in Table I.

TABLE I

| Ex. | IL I(mol %) | Dopant Location | SSL I(mol %) | CN Process Speed | CN Process Fog | CR Process Speed |
|---|---|---|---|---|---|---|
| 1 | 0 | IL + SSL | 0 | 213 | 0.134 | 236 |
| 2 | 0 | SSL | 0.3 | 207 | 0.089 | 237 |
| 3C | 0 | None | 0.3 | 189 | 0.124 | 216 |
| 4 | 20 | IL + SSL | 0.6 | 211 | 0.140 | 230 |
| 5C | 20 | None | 0.6 | 202 | 0.088 | 228 |
| 6 | 20 | SSL | 0.9 | 220 | 0.108 | 243 |
| 7C | 20 | HS + IL + SSL | 2.3 | 200 | 0.087 | 233 |

IL = Isolation Layer
HS = Host Stratum
SSL = Subsurface Layer
CN = Color Negative Processing
CR = Color Reversal Processing
Speed = Threshold speed By comparing Examples 1 and 2 with Example 3C and Example 4 with Example 5C it is apparent that the dopant increases the speed of the tabular grain emulsions. By comparing Example 2 with control Example 3C and Example 4 with control Example 5C, where the sole difference between the emulsions compared is the presence or absence of the cyanide ligand hexacoordination complex, it is apparent that the incorporated hexacoordination complex increases the speed of the emulsion. When the isolation layer contained 20 mole percent iodide, there was, in effect, no isolation layer present. That is, the isolation layer was in this instance a part of the relatively higher iodide portion of the grains. The incorporated coordination complex increased speed in all instances, except in control Example 7C, where the iodide level exceeded 2 mole percent in the subsurface layer.

The invention has been described in detail with particular reference to preferred embodiments thereof, but it will be understood that variations and modifications can be effected within the spirit and scope of the invention.

What is claimed is:

1. A photographic emulsion comprised of radiation sensitive silver iodobromide grains, at least 50 percent of the total projected area of said silver iodobromide grains being accounted for by tabular grains exhibiting a means tabularity of greater than 5, at least 10 percent of which are comprised of two opposed parallel major crystal faces, a host stratum having an iodide content of at least 4 mole percent, and laminar strata containing less than 2 mole percent iodide forming said opposed major crystal faces and separating said host stratum from said opposed major crystal faces, characterized in that each of said laminar strata is comprised of a surface layer forming one of said major crystal faces and having a thickness in the range of from 20 to 350 Å and which is not doped with a transition metal coordination complex, and a subsurface layer located immediately beneath and in contact with said surface layer containing a hexacoordination complex of a Group VIII period 4 or 5 metal and at least three cyanide ligands.

2. An emulsion according to claim 1 further characterized in that said host stratum accounts for from 20 to 80 percent of total grain volume.

3. An emulsion according to claim 2 further characterized in that said host stratum accounts for from 35 to 65 percent of total grain volume.

4. An emulsion according to claim 1 further characterized in that said tabular grains contain from about 0.1 to 20 mole percent iodide, based on total silver.

5. An emulsion according to claim 4 further characterized in that said tabular grains contain from about 1 to 10 mole percent iodide, based on total silver.

6. An emulsion according to claim 1 further characterized in that a spectral sensitizing dye is adsorbed to the major faces of the tabular grains.

7. An emulsion according to claim 1 further characterized in that the concentration of said hexacoordination complex in said subsurface layer is less than 0.1 mole percent, based on silver.

8. An emulsion according to claim 7 further characterized in that the concentration of said hexacoordination complex in said subsurface layer is in the range of from $2.5\times10^{-3}$ to $5\times10^{-2}$ mole percent, based on silver.

9. An emulsion according to claim 1 further characterized in that said laminar strata additionally each includes an isolation layer containing less than 2 mole percent iodide interposed between said host stratum and each of said subsurface layers.

10. An emulsion according to claim 9 further characterized in that surface and subsurface layers are each substantially free of iodide.

11. An emulsion according to claim 1 further characterized in that said hexacoordination complex satisfies the formula:

$$[M(CN)_{6-y}L_y]^n$$

where

M is a transition metal chosen from one of periods 4 and 5 of Group VIII,

L is a bridging ligand, y is the integer zero, 1, 2 or 3 and n is -2, -3, or -4.

12. An emulsion according to claim 11 further characterized in that L is a halide ligand.

13. An emulsion according to claim 11 further characterized in that M is chosen from among iron, ruthenium and rhodium.

14. An emulsion according to claim 13 further characterized in that said hexacoordination complex satisfies the formula $$[Fe(CN)_6]^{-4}.$$

15. An emulsion according to claim 1 further characterized in that said surface layers have a thickness in the range of from 25 to 100 Å.

16. An emulsion according to claim 1 further characterized in that the iodide in said laminar strata is less than 1.5 mole percent.

17. An emulsion according to claim 16 further characterized in that the iodide level in the laminar strata is less than 1.0 mole percent.

* * * * *